US009487939B1

(12) United States Patent
Cook

(10) Patent No.: US 9,487,939 B1
(45) Date of Patent: Nov. 8, 2016

(54) PRE-MOISTENED (WET) WITH SURFACTANT AND HUMECTANT, FLUSHABLE, TOILET BOWL LINER SHIELD WHICH REDUCES THE NEED FOR MANUAL CLEANING BY PROVIDING A BARRIER SHIELD BETWEEN THE BOWL OF THE TOILET AND SOLID WASTE AND USING AN ESSENTIAL OIL BASED WATER SURFACE BARRIER TO REDUCE OR ELIMINATE TOILET ODOR

(71) Applicant: Erica Ridgeway Cook, San Jose, CA (US)

(72) Inventor: Erica Ridgeway Cook, San Jose, CA (US)

( * ) Notice: Subject to any disclaimer, the term of this patent is extended or adjusted under 35 U.S.C. 154(b) by 0 days.

(21) Appl. No.: 15/018,822

(22) Filed: Feb. 8, 2016

(51) Int. Cl.
*E03D 9/00* (2006.01)
*A47K 11/10* (2006.01)

(52) U.S. Cl.
CPC ..... *E03D 9/007* (2013.01); *A47K 11/105* (2013.01); *E03D 9/00* (2013.01)

(58) Field of Classification Search
CPC ..... A47K 13/24
USPC ..... 4/300.3
See application file for complete search history.

(56) References Cited

U.S. PATENT DOCUMENTS

| | | | | |
|---|---|---|---|---|
| 4,010,497 | A * | 3/1977 | Menter | E03D 9/00 4/222 |
| 4,705,050 | A * | 11/1987 | Markham | A61B 10/0038 4/300.3 |
| 6,081,937 | A * | 7/2000 | Whitacre | E03D 9/00 4/300.3 |
| 6,374,428 | B1 * | 4/2002 | Copeland | A47K 17/00 4/300.3 |
| 6,564,399 | B1 * | 5/2003 | Teal | A47K 11/105 4/300.3 |
| 8,112,828 | B1 * | 2/2012 | Varela, III | A47K 11/105 4/300.3 |
| 2004/0093663 | A1 * | 5/2004 | Zhu | E03D 9/00 4/300.3 |
| 2007/0039089 | A1 * | 2/2007 | Worrel | E03D 9/00 4/300.3 |

* cited by examiner

*Primary Examiner* — Huyen Le

(57) ABSTRACT

A pre-moistened (wet) with surfactant and humectant, flushable, toilet bowl liner shield which reduces the need for manual cleaning by providing a barrier shield between the bowl of the toilet and solid waste and using an Essential Oil based water surface barrier to reduce or eliminate toilet odor. The pre-moistened toilet bowl liner shield is for use in a flushable toilet wherein the water has an upper surface. The upper surface of the flat liner sits directly on top or slightly under the upper surface edge of the water. The liners reduce or prevent soiling of the interior of a toilet bowl and for efficient removal and flushing of human waste. The liners are treated with Essential Oils that create a surface barrier and reduce or eliminate toilet odor.

10 Claims, 2 Drawing Sheets

PRE-MOISTENED (WET) WITH SURFACTANT AND HUMECTANT, FLUSHABLE, TOILET BOWL LINER SHIELD WHICH REDUCES THE NEED FOR MANUAL CLEANING BY PROVIDING A BARRIER SHIELD BETWEEN THE BOWL OF THE TOILET AND SOLID WASTE AND USING AN ESSENTIAL OIL BASED WATER SURFACE BARRIER TO REDUCE OR ELIMINATE TOILET ODOR

CROSS-REFERENCE TO RELATED APPLICATION

There are no prior or parent applications related to this invention application.

STATEMENT REGARDING FEDERALLY SPONSORED RESEARCH OR DEVELOPMENT

This invention application is not the subject of any federally sponsored research and development.

REFERENCE TO SEQUENCE LISTING, A TABLE, OR COMPUTER PROGRAM LISTING COMPACT DISC APPENDIX

Not Applicable

BACKGROUND OF THE INVENTION

1. Field of the Invention

The present invention relates to pre-moistened (wet) with surfactant, humectant, flushable toilet bowl liner shield that is a barrier shield between the bowl of the toilet and solid waste reducing the need for manual cleaning and is permeated with an Essential Oil based water surface barrier to reduce or eliminate toilet odor.

2. Description of Prior Art

The use of dry disposable toilet bowl liner shield is known in the prior art for use in toilets, bedpans, potty chairs and other receptacles for disposal of human waste. The materials used are woven, non-woven, dissolvable when in contact with water, biodegradable, polymers and the like.

U.S. Pat. No. 20090113613 A1 teaches a liner for waste eliminations systems is shaped in a circle with fluted edges that defines to the toilet bowl with an upper surface, a lower surface and a peripheral edge. The liners prevent soiling of the interior of a toilet bowl and for efficient removal and flushing of human waste. The patent does not teach pre-moistened (wet) with surfactant and humectant liner or the use of Essential Oils as a water surface barrier to reduce or eliminate toilet odor.

U.S. Pat. No. 6,564,399 teaches liners for use in toilet bowls that are flat sheets that have an oval, round or polygonal exterior peripheral edge, and have wedge-like slits along the periphery of the liners. The wedge-like slits are cut in the liner towards the center of the liner, with the wider portions of the wedges being located on the peripheral edge of the liner. The liners are formed of material that retains its structural integrity while in use, but disperses in contact with water. The patent does not teach pre-moistened (wet) with surfactant and humectant liner or the use of Essential Oils as a water surface barrier to reduce or eliminate toilet odor.

U.S. Pat. 20090158514 A1 teaches a flushable bowl protecting liner which reduces the need for manual cleaning by providing a barrier between the bowl off the toilet and solid waste used in toilets with limited water supply and do not have a large water reservoir held in the bowl during each use. The application is directed to toilets in recreational motor vehicles, aircraft and boats. The liner is conical in shape and the material decomposes in water. The patent does not teach pre-moistened (wet) with surfactant and humectant liner or the use of Essential Oils as a water surface barrier to reduce or eliminate toilet odor.

U.S. Pat. No. 4,979,237 teaches a disposable toilet seat cover. The patent does not teach the use of bowl liners as a barrier to shield solid waste from the toilet bowl. The patent does not teach pre-moistened (wet) with surfactant and humectant liner or the use of Essential Oils as a water surface barrier to reduce or eliminate toilet odor.

U.S. Pat. No. 5,611,092 teaches a child's training toilet with a disposable liner. The liner is designed to be used with a dry or non-flushing toilet. The patent does not teach the use of a liner designed for use in conjunction with a standard flush toilet.

U.S. Pat. No. 5,985,396 teaches a material film that maintains its' strength and integrity when in use but disperses when placed in contact with water. The patent does not teach pre-moistened (wet) surfactant and humectant liner or the use of Essential Oils as a water surface barrier to reduce or eliminate toilet odor. The patent does not teach the use of bowl liners as a barrier to shield solid waste from the toilet bowl.

U.S. Pat. No. 5,745,929 teaches a covering for a toilet seat and external portion of the toilet bowl. The patent does not teach the use of bowl liners as a barrier to shield solid waste from the toilet bowl.

U.S. Pat. No. 8,484,791 B2 teaches a pad that is curved to fit the inside surface of a toilet. The patent does not teach pre-moistened (wet) surfactant and humectant liner or the use of Essential Oils as a water surface barrier to reduce or eliminate toilet odor. The patent does not teach the use of bowl liners as a barrier to shield solid waste from the toilet bowl.

U.S. Pat. No. 6,797,399 B2 teaches a cleaning article have a substrate capable of absorbing and retaining a fluid herein, impregnated with a cleansing composition containing mixed ether. The patent does not teach disposable, flushable, nor the use of bowl liners as a barrier to shield solid waste from the toilet bowl or the use of Essential Oils as a water surface barrier to reduce or eliminate toilet odor.

U.S. Pat. No. 5,629,081 A teaches a pre-moistened, dispersible, biodegradable, flushable, disposable wet wipe with lotion. The patent does not teach toilet bowl liners as a barrier to shield solid waste from the toilet bowl. The patent does not teach the use of Essential Oils as a water surface barrier to reduce or eliminate toilet odor.

U.S. Pat. No. EP2737119 A1 teaches a flushable moist wipe or hygiene tissue comprising a hydraulically entangled nonwoven material impregnated with a wetting composition. The patent does not teach toilet bowl liners as a barrier to shield solid waste from the toilet bowl. The patent does not teach the use of Essential Oils as a water surface barrier to reduce or eliminate odor.

U.S. Pat. No. WO2002027089 A1 teaches a non woven, disposable, embossed, soft, flexible wipe suitable for use as a pre-moistened baby wipe comprised of thermoplastic fibers and embossed with a pattern. The patent does not teach toilet bowl liners as a barrier to shield solid waste from the toilet bowl. The patent does not teach the use of Essential Oils as a water surface barrier to reduce or eliminate toilet odor.

U.S. Pat. No. WO2013018805 A1 teaches fragrance for suppressing fecal odor, microencapsulated fragrance using same, textile having fecal odor suppressing capability, pellet for suppressing fecal odor, microencapsulated fragrance misting spray and spray for suppressing fecal odor. The patent does not teach the use of bowl liners as a barrier to shield solid waste from the toilet bowl. The patent does not teach pre-moistened (wet) surfactant liner.

U.S. Pat. No. 20140199257 A1 teaches a method and composition of reducing toilet odor containing polypropylene glycol that aids in the reduction of objectionable volatile odors when a few drops are placed in the toilet prior to use to create a "reactive" barrier. The composition may also optionally include one or more essential oils, fragrances or colorants. The patent does not teach pre-moistened (wet) with surfactant liner or the use a surface barrier to reduce or eliminate odor. The patent does not teach the use of bowl liners as a barrier to shield solid waste from the toilet bowl.

U.S. Pat. No. 7,229,612 B2 teaches compositions for human and animal excrement, especially pest and livestock, comprised of acidic agents and water soluble polymers, wherein the acidic agents are base neutralizers for the ammonia and indolic amines in the excrement and water soluble polymers are barrier forming agents for the vapor of the offensive odor producing compounds in the excrement and for slowing down the air oxidative and enzymatic nitrification of the excrement ammonia and organic nitrogen. Said compositions may be applied to excrement in liquid or spray form. The patent does not teach the use of bowl liners as a barrier to shield solid waste from the toilet bowl. The patent does not teach pre-moistened (wet) with surfactant liner or the use of Essential Oils as a water surface barrier to reduce or eliminate toilet odor.

U.S. Pat. No. 7,998,921 teaches A method of reducing toilet odor, the method comprising the step of applying a liquid composition directly to water contained in a toilet bowl prior to that forms a sheen sufficient to cover essentially the entire surface of the water, and reduces toilet odors during and following usage of the toilet bowl. The patent does not teach the use of bowl liners as a barrier to shield solid waste from the toilet bowl. The patent does not teach pre-moistened (wet) with surfactant liner or the use of Essential Oils as a water surface barrier to reduce or eliminate odor.

U.S. Pat. No. 20030068295 A1 teaches this invention relates to odor neutralizers comprising esters. The patent does not teach the use of bowl liners as a barrier to shield solid waste from the toilet bowl. The patent does not teach pre-moistened (wet) with surfactant liner or the use of Essential Oils as a water surface barrier to reduce or eliminate odor.

One odor reducing toilet surface barrier marketed as "Poo Pourri" by S2 Synergy, LLC, Adison, Tex. uses Essential Oils and other products as a surface barrier that is sprayed on the toilet water prior to using the toilet. The patent does not teach the use of bowl liners as a barrier to shield solid waste from the toilet bowl. The patent does not teach pre-moistened (wet) with surfactant and humectant liner.

One odor reducing toilet surface barrier produced and marketed as "Powerful One Drop" by Kobayashi Pharmaceutical Co. Ltd. of Japan uses fragrances, plant extract, and glycol ether as a surface barrier that is a liquid dropped into the toilet water prior to using the toilet. The patent does not teach the use of bowl liners as a barrier to shield solid waste from the toilet bowl. The patent does not teach pre-moistened (wet) with surfactant and humectant liner or the use of Essential Oils as a water surface barrier to reduce or eliminate odor.

While these devices fulfill their respective, particular objectives and requirements, the aforementioned patents and other marketed items do not disclose a new flushable bowl protecting liner that is inclusive of being pre-moistened with a surfactant and humectant, providing a barrier shield between the bowl and solid waste, and permeated with Essential Oils that form a surface barrier in the toilet water to reduce or eliminate odor. The flushable pre-moistened bowl protecting liner forming a barrier between the solid waste an bowl as well as having a water surface barrier using Essential Oils according to the present invention substantially departs from the conventional concepts and designs of the prior art, and in so doing provides an apparatus primarily developed for the purpose of reducing the need for manual cleaning by providing a barrier between the solid a waste and bowl of the toilet and also reducing or eliminating the odor through the use of a surface barrier.

BRIEF SUMMARY OF THE INVENTION

In view of the foregoing disadvantages inherent in the known types of toilet bowl liners now present in the prior art, the present invention provides an inclusive new pre-moistened with surfactant and humectant flushable bowl protecting liner construction wherein the same can be utilized for reducing the need for manual cleaning by providing a barrier between the bowl of the toilet and solid waste while at the same time providing a water surface barrier of Essential Oils to reduce or eliminate odor.

To attain these benefits described herein the present invention is a liner shield for use in a flush toilet bowl with water. The flat sheet is a flexible, non-woven, flushable square, rectangle, circle, oval or polygonal shield that is pre-moistened using a surfactant and humectant and permeated with Essential Oils and is designed to be placed in the toilet bowl that would act as a shield between the bowl and solid waste to prevent contact between the solid waste and the bowl. The sheet lies flat on or just under the upper surface of the toilet water to form a cleansing barrier shield between the bowl and the solid waste. The Essential Oils form a surface barrier in the toilet bowl water to reduce or eliminate the smell of solid waste.

There has thus been outlined, rather broadly, the more important features of the invention in order that the detailed description thereof that follows may be better understood, and in order that he present contribution to the art may be better appreciated.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure.

BRIEF DESCRIPTION OF THE SEVERAL VIEWS OF THE DRAWING

The foregoing summary, as well as the following detailed description of the preferred embodiments of the invention, will be better understood when read in conjunction with the appended drawings. For the purpose of illustrating the invention, there is shown in the drawings embodiments that are presently preferred, but it should be noted, however, that the invention is not limited to the precise arrangements and instrumentalities shown. In the drawings.

DETAILED DESCRIPTION OF THE INVENTION

Pre-moistened toilet bowl liner shields are described herein for use in flush toilets having a toilet bowl or similar water pressure operated flushing devices for receiving solid human waste. As described herein for the purpose of describing a preferred embodiment, a typical toilet bowl is used for reference purposes. In use, however, the pre-moistened toilet bowl liner shield may be used in any toilet or similar device having a bowl of any size and shape that holds water in any amount or chemically treated liquids for flushing solid human waste and has an upper surface area.

Figure 1:
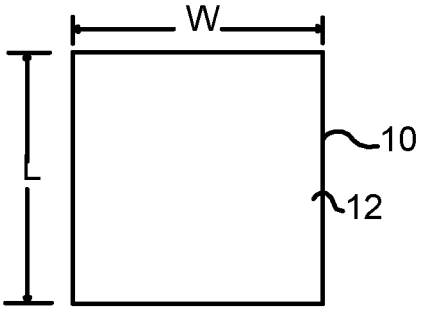
FIG. 1 is a top plan view of a pre-moistened toilet bowl liner shield with a square shape according to an embodiment described herein.
Figure 2:
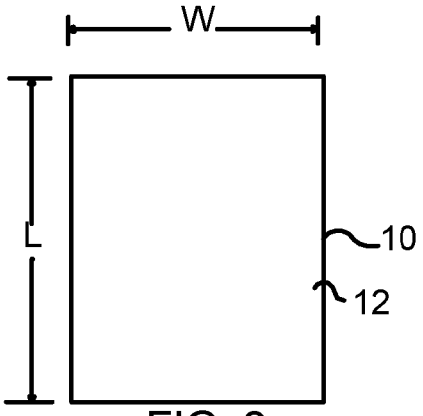
FIG. 2 is a top plan view of a pre-moistened toilet bowl liner shield with a rectangular shape according to an embodiment described herein.
Figure 3:
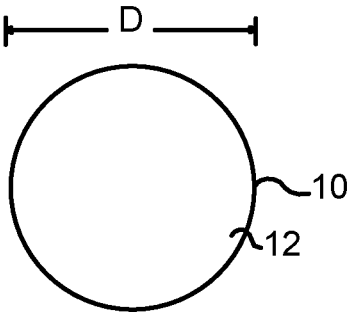
FIG. 3 is a top plan view of a pre-moistened toilet bowl liner shield with a circular shape according to an embodiment described herein.
Figure 4:
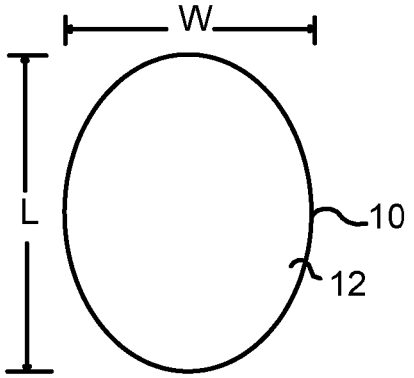
FIG. 4 is a top plan view of a pre-moistened toilet bowl liner shield with an oval shape according to an embodiment described herein.
Figure 5:
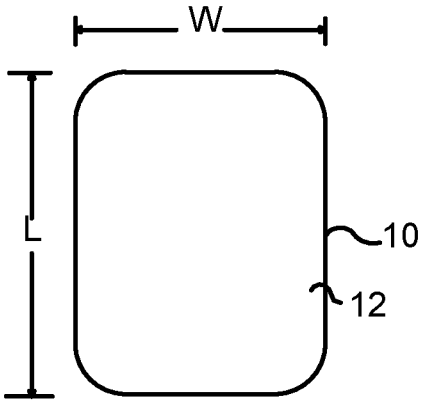
FIG. 5 is a top plan view of a pre-moistened toilet bowl liner shield with a polygonal shape according to an embodiment described herein.
Figure 6:
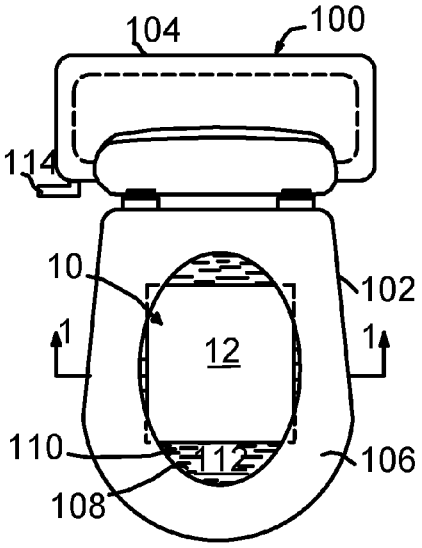
FIG. 6 is a top plan view of a toilet having a toilet bowl with the pre-moistened toilet bowl liner shield of FIG. 1 which also serves as the typical representation of the same for FIG. 2, FIG. 3, FIG. 4, and FIG. 5.
Figure 7:
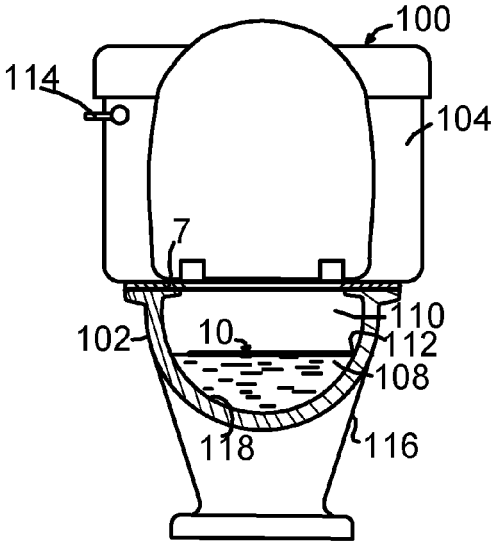
FIG. 7 is a side cross sectional view of the toilet and pre-moistened toilet bowl liner of FIG. 6 taken along line 1-1 in FIG. 6. Again, the pre-moistened toilet bowl liner shield as shown is FIG. 1, but also serves as the typical representation of the same for FIG. 2, FIG. 3, FIG. 4 and FIG. 5.

An example of a typical toilet for use in explain operation of the liners herein is shown in FIG. 6 and FIG. 7. The toilet 100 has a base 116 and a bowl 102 that creates an interior space 110 that holds water 108. The toilet has a seat 106, a flush handle 114 that when actuated flushes the water within the tank 104. The water 108 has an upper surface 112. It is understood from the disclosure herein that toilet 100 is a representative example only and that various toilets with different designs will benefit from use of the pre-moistened liner shield described herein.

A toilet bowl liner shield referred to generally with respect to reference number 10 in FIG. 1 through FIG. 7 as described herein is a flat sheet and has an upper surface 12. The liner 10 is a flexible pre-moistened (wet) sheet with surfactant and humectant permeated with essential oils floats on top or just under the water upper surface 112.

The pre-moistened toilet bowl liner shield may be formed in a flat sheet. The shape of the sheet may conform to the interior shape of the toilet bowl 102. Such shapes may include circles, ovals, squares, rectangles, polygons, etc. The size of the pre-moistened toilet bowl liner shield will be a width (W) or diameter (D) shown on FIG. 1-5 from 15 cm to 35 cm and having a length (L) of 15 cm to 35 cm as shown on FIGS. 1,2,4 and 5.

It has been determined that the best material for a flushable a pre-moistened toilet bowl liner shield 10 are those made of non-woven paper material of either one ply or many plies consisting of cellulosic fibers, poly(lactic) fibers, and weight binder fiber components. The best of such paper is a combination of one or many of the fibers mentioned above but generally in the range of 40%-70% cellulosic fibers.

The pre-moistened toilet bowl liner shield may have a basis weight between 30-100 g/m$^2$ wherein the basis weight is calculated on the nonwoven material without the wetting composition, and may have a wet strength between 20 and 200 N/M. The ideal strength is so that upon application of weight from solid waste or a downward application of force by dropping it into the toilet bowl that the toilet bowl shield 10 remains whole.

The pre-moistened toilet bowl liner shield 10 with an Essential Oil surface barrier will contain a wetting composition of water, surfactant, humectant, alcohol, and essential oils applied either in a single operation or a multi-stage operation. Each pre-moistened toilet bowl liner shield will be made wet with 1%-5% humectant such as glycerin and/or propylene glycol, 5%-15% surfactant such as soap, 1%-15% alcohol, 0.05%-10% Essential Oils and water to make the remaining total of 100%.

With respect to the above description then, it is to be realized the the optimum relationships for the parts of the invention, in include variations in size, variations in materials, quantities of materials, shape, form, function and manner of operation, assembly and use are deemed reality apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A pre-moistened liner shield for preventing solid waste from contacting the surface of a toilet bowl while reducing or eliminating odor through use of a surface barrier, for use in a flush toilet having a bowl with an interior area and holding water, wherein the water has an upper surface, the liner shield comprising:

an upper surface flushable a flat sheet of nonwoven material to maintain its structural integrity and strength when in use pre-moistened with surfactant and humectant permeated with Essential Oils to create a surface barrier wherein the the liner sits on or directly under the upper surface of water within an interior area of a toilet bowl.

2. The liner shield according to claim 1, wherein the shape is square, rectangular, circular, oval or polygonal and has an upper surface.

3. The liner shield according to claim 1, wherein the width or diameter is 15 cm to 35 cm.

4. The liner shield according to claim 1, wherein the length is 15 cm to 35 cm.

5. The liner shield according to claim 1, wherein the material is non-woven material made of one ply or many plies.

6. The liner shield according to claim 1, wherein the flushable material is a combination of one or many fibers consisting of cellulosic fibers, poly(lactic) fibers, and weight binder fiber, but generally in the range of 40%-70% cellulosic fibers.

7. The liner shield according to claim 1, wherein the material may have a basis weight between 30-100 $g/m^2$ calculated on the nonwoven material without the wetting composition.

8. The liner shield according to claim 1, wherein the material may have a wet strength between 20-200 N/M.

9. The liner shield according to claim 1, wherein the material is pre-moistened and a surface barrier is created with a wetting composition of water, surfactant, humectant, alcohol and essential oils.

10. The liner shield according to claim 9, wherein the liner shield will be made wet with 1%-5% humectant such as glycerin or/or propylene glycol, 5%-15% surfactant such as soap, 1%-15% alcohol, 0.05%-10% Essential Oils and water to make the remaining total of 100%.

* * * * *